US006224230B1

(12) United States Patent
Roegiers

(10) Patent No.: US 6,224,230 B1
(45) Date of Patent: May 1, 2001

(54) ORNAMENT LIGHTING APPARATUS

(76) Inventor: Leon Scott Roegiers, 582 Scenic Ave., San Anselmo, CA (US) 94960

( * ) Notice: Subject to any disclaimer, the term of this patent is extended or adjusted under 35 U.S.C. 154(b) by 0 days.

(21) Appl. No.: 09/316,844

(22) Filed: May 21, 1999

Related U.S. Application Data

(63) Continuation-in-part of application No. 09/107,050, filed on Jun. 29, 1998.

(51) Int. Cl.[7] ..... F21S 6/06

(52) U.S. Cl. ..... 362/123; 362/191; 362/196; 362/396; 362/806

(58) Field of Search ..... 362/123, 195, 362/806, 808, 809, 186, 204, 363, 191, 196, 396

(56) References Cited

U.S. PATENT DOCUMENTS 3,011,049 * 11/1961 Kinghorn ..... 362/123
3,655,495 * 4/1972 Carrell ..... 161/16
3,694,648 * 9/1972 Yates ..... 240/10
3,873,880 * 3/1975 Riddell ..... 315/53
4,452,836 * 6/1984 Daniel, Jr. ..... 428/11
4,652,980 * 3/1987 Segan ..... 362/86
5,599,092 * 2/1997 Yen ..... 362/294
5,822,088 * 10/1998 Danno et al. ..... 359/1

* cited by examiner

*Primary Examiner*—Stephen Husar
*Assistant Examiner*—John Anthony Ward
(74) *Attorney, Agent, or Firm*—Johnson & Stainbrook, LLP; Larry Johnson; Craig M. Stainbrook

(57) ABSTRACT

A Christmas tree ornament spotlight that decoratively illuminates ornaments by means of a miniature spotlight. When not in operation, the present invention is itself a tree ornament. When in operation it both enhances the decorative effect of other ornaments and itself has decorative effect, both in its inherently ornamental housing, and in the patterns of the beams of light cast by its spotlight. The direction of the light beam relative to the vertical and horizontal axes may be adjusted and fixed so as to particularly illuminate neighboring ornaments and/or for creating a distinctive pattern of light beams.

9 Claims, 2 Drawing Sheets

ORNAMENT LIGHTING APPARATUS

This application is a continuation-in-part of application Ser. No. 09/107,050, filed Jun. 29, 1998 by applicant herein.

BACKGROUND OF THE INVENTION

1. Field of the Invention

This invention relates in general to electric spotlights, and more particularly, to a Christmas tree ornament spotlight that directs light to other ornaments.

2. Brief Description of the Prior Art

For several decades people of many cultures around the world have annually decorated Christmas trees with ornaments and strings of light. Ordinarily, the string of lights functions primarily as a decoration unto itself, and only secondarily and indirectly as a means of illuminating the unlighted ornaments or other decorations. Thus, only when ambient light is relatively high are the unilluminated tree ornaments fully displayed. However, when the ambient light is low, many ornaments cannot be viewed and a significant component of the decorative effect of the tree may be lost. Increasing ambient light to increase the visibility of the ornaments may compromise the decorative effect of the lights strung on the tree. Additionally, selectively (spot) lighting ornaments from sources physically independent of the decorated tree may compromise the decorative aesthetic and require cumbersome apparatus.

Therefore, there is a need for a simple means to illuminate Christmas tree ornaments in low ambient light conditions without compromising the beautiful effect of the illuminated string of lights. Heretofore, there are no known lighting devices that accomplish these objectives.

SUMMARY OF THE INVENTION

The Christmas tree ornament spotlight of the present invention solves the above-described problems. As implied by the delineation of problems, the primary purpose of the present invention is to decoratively illuminate ornaments by means of a miniature spotlight, which is itself a tree ornament and which not only enhances the decorative effect of other ornaments, but itself has decorative effect, both in its housing, and in the patterns of the beams of light cast by the spotlight.

To achieve this purpose, the present invention essentially comprises a hollow and preferably generally spherical housing having an integrally formed groove cut into the apex of its superior portion. The groove extends forward and rearward from the apex. Integrally formed with and extending forwardly from the spherical housing is a hollow and preferably generally cylindrical housing.

The spherical housing hangs from the branch of a Christmas tree, or other small diameter overhead fixture, by means of an eye hook connected to and through the superior surface of the spherical housing at the aforementioned groove. The eye hook may be slid forward and backward in the groove as well as rotated within the groove.

Each of the spherical and cylindrical housings are preferably formed by coupling two halves defined by a cut along the longitudinal axis of the cylindrical housing and through the apex of the superior surface of the spherical housing.

Housed at the proximal end of the hollow cylindrical housing, and partly within the spherical housing, is a smooth or faceted reflector having a forwardly facing concave distal surface and an opening for a lamp bulb.

Mounted partly within both the cylindrical housing and the spherical housing, is a light source electrically connected to a source of electrical power, and located such that light from the light source can be reflected off the reflector to produce a cylindrical or other beam of light.

A key feature of the present invention is its maneuverability. The beam of light emitted from the cylindrical housing can be selectively pointed and fixed in a large range of directions for highlighting particular neighboring ornaments and/or for creating a distinctive pattern of light beams.

DETAILED DESCRIPTION OF A PREFERRED EMBODIMENT

Figure 1:
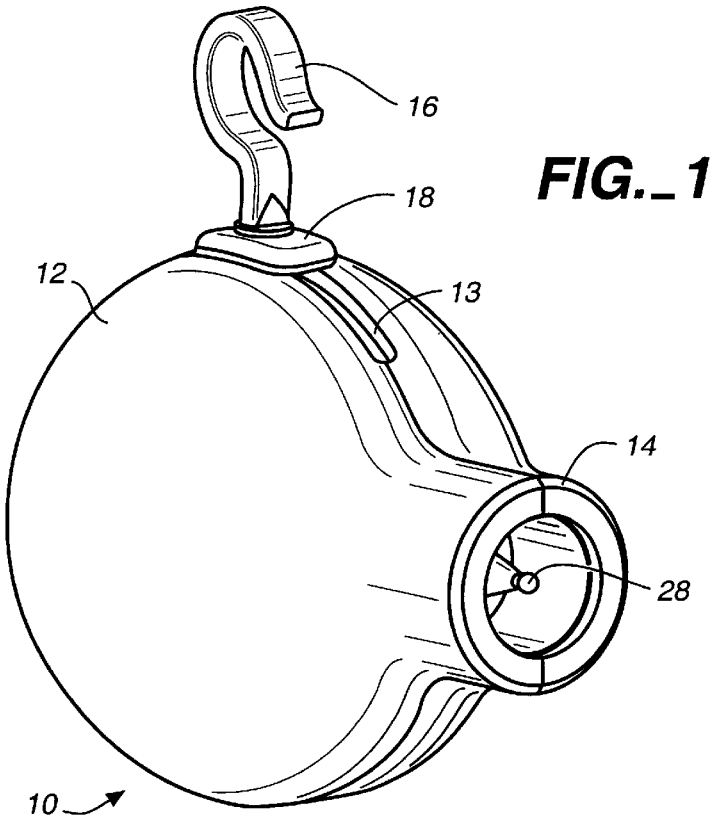
FIG. 1 is a perspective view of a Christmas tree ornament spotlight constructed in accordance with and embodying the present invention.

In the illustrated embodiment, as shown in FIG. 1, the present invention 10 essentially comprises a hollow spherical housing 12 having a groove 13 cut into the apex of the superior portion of said spherical housing and extending forwardly and rearwardly from the apex. Integrally formed with and extending forwardly from the spherical housing 12 is a hollow cylindrical housing 14, which is open at both its proximal and distal ends.

Figure 2:
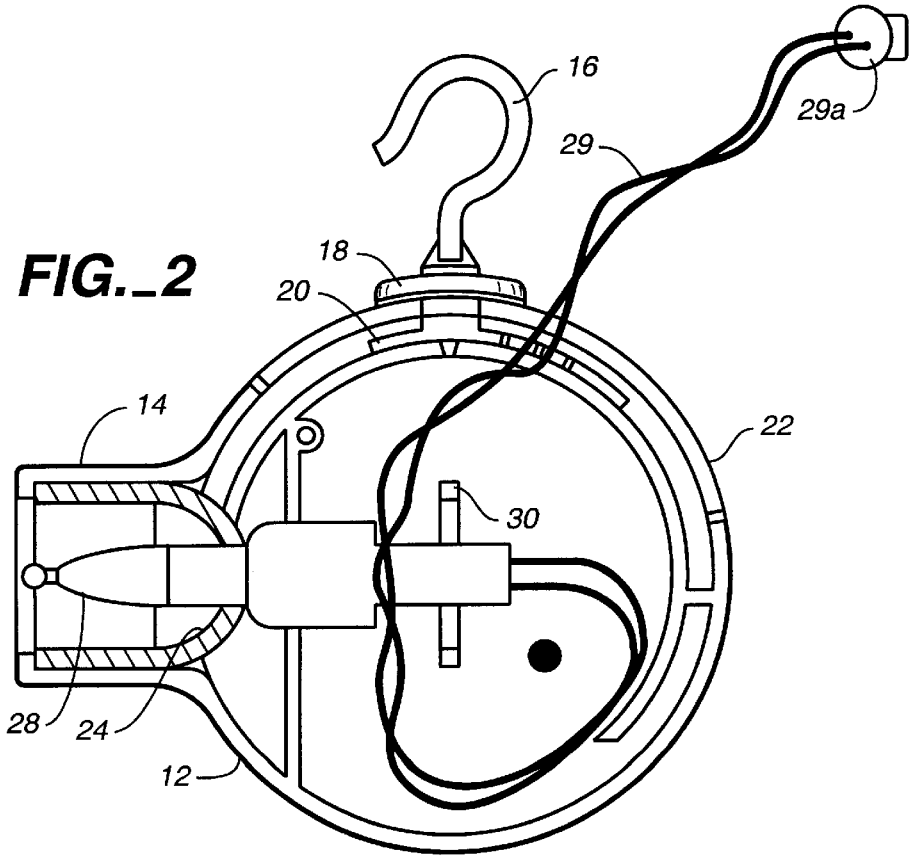
FIG. 2 is a side elevation cross-sectional view of the Christmas tree ornament spotlight of FIG. 1.
Figure 3:
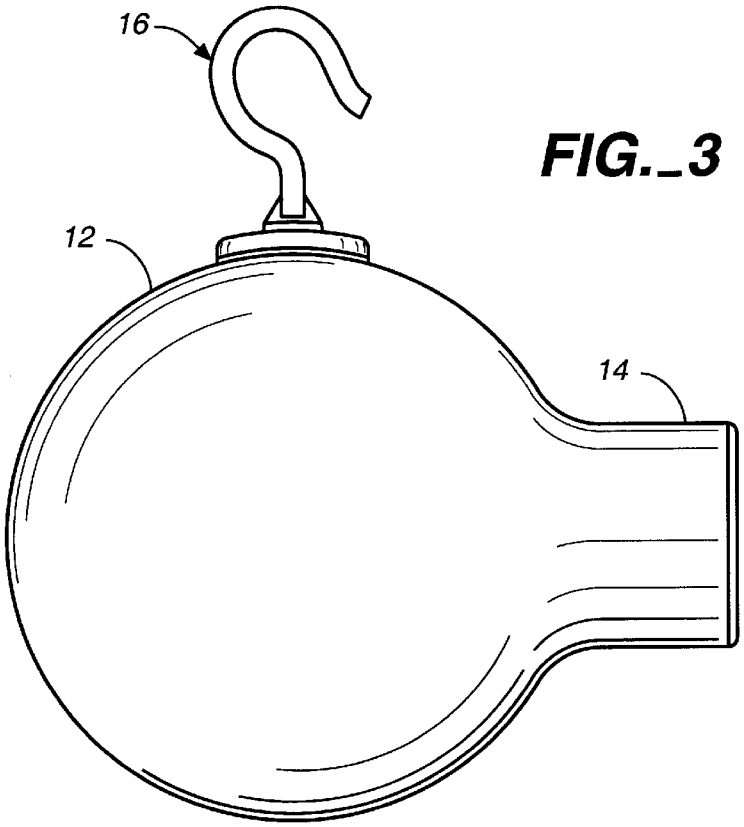
FIG. 3 is a side elevational view of the Christmas tree ornament spotlight.

As shown in FIGS. 1–4, the means for hanging the present invention from the branch of a Christmas tree, or other small diameter overhead fixture, comprises an open eye hook 16. FIG. 2 shows that the eye hook has as its base a first integrally formed substantially rectangular flange 18 overlying the outer surface of the spherical housing and a second substantially rectangular inverted T-shaped flange 20 underlying and integrally connected to the first flange and underlying the interior surface of the spherical housing.

Each of the spherical and cylindrical housings are preferably formed by coupling two halves of the spherical and cylindrical members defined by a cut along the longitudinal axis of the cylindrical housing and through the apex of the superior surface of the spherical housing, shown in FIG. 2.

FIG. 2 is a cutaway view of the invention, and shows the female half of the housing members, including an integrally formed sleeve 22 for receiving the tapered edge of the male half (not shown), which when coupled form the hollow spherical and cylindrical housing members, 12 and 14 respectively.

FIG. 2 further illustrates that housed at the proximal end of the hollow cylindrical housing, and partly within the hollow of the spherical housing, is a smooth or faceted reflector 24, having a forwardly facing concave distal surface and an opening for receiving the bulb portion of a lamp bulb and having a diameter that is substantially the same as the interior surface of the cylindrical housing.

Mounted partly within both the cylindrical housing 14 and the spherical housing 12, is a light source 28 electrically connected to a source of electrical power, and located such that the light source can reflect light off the reflector 24 to provide a generally cylindrical beam of light forward from the cylindrical housing. The light source would preferably be either a bulb with a filament or a standard Christmas tree mini-light.

Electrical power to the light source would preferably comprise a length of insulated double-stranded wire 29 having a male electrical connector 29*a* at the terminal end of the length of double-stranded wire 29 suitable for insertion into a light housing on an existing strand of Christmas tree mini-lights. In this embodiment, the spherical housing would include an aperture for passage of the electrical wires.

Figure 4:
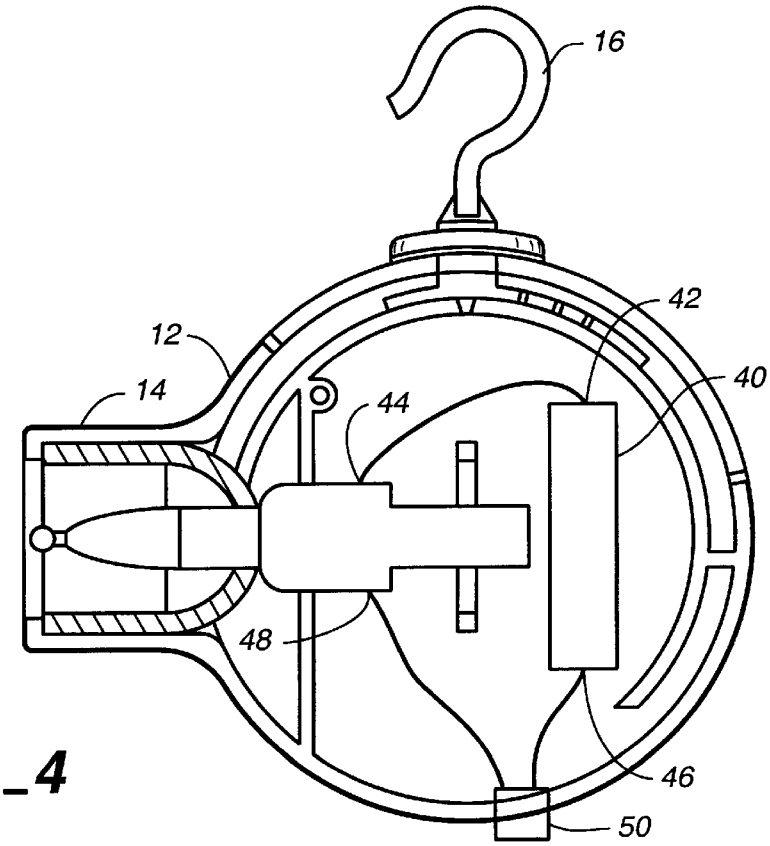
FIG. 4 is a side elevation cross-sectional view of an alternate embodiment of the invention.

Alternatively, and as illustrated in FIG. 4, the spherical housing would have an assembly 40 suitable for holding one or more batteries as a source of electric power, a first contact 42 electrically coupling one electrode of (one of) the batter (ies) to a first terminal of the light source 44, a second contact 46 electrically coupling another electrode of (one of) the batter(ies) to a second terminal of the light source 48, and a switch 50 associated with the spherical housing to turn said light source on and off.

One of the key features of the present invention is its maneuverability, such that the beam of light emitted from the cylindrical housing can be selectively pointed and fixed in a large range of directions for highlighting particular neighboring ornaments and/or for creating a distinctive pattern of light beams. This feature is accomplished by providing means whereby the spherical housing can be moved and fixed in position relative to the eye hook from which it hangs. Forming the base of the eye hook, and overlying the outer surface of the spherical housing, is a first substantially rectangular flange 18, which is integrally connected to a second substantially rectangular flange 20, shaped as an inverted T and underlying the under surface of the first flange and further underlying the interior surface of the spherical housing. The eye hook can be rotated and can be moved forward and back along the groove at the superior portion of the spherical housing.

FIG. 2 also shows how in the preferred embodiment each half of the spherical housing includes an integrally formed U-shaped bracket 30, which when the two halves are clamped together formed a substantially rectangular bracket with an interior rectangular aperture for holding a Christmas tree mini-light as a light source.

While this invention has been described in connection with preferred embodiments thereof, it is obvious that modifications and changes therein may be made by those skilled in the art to which it pertains without departing from the spirit and scope of the invention. For example, colored lights and/or lenses may be utilized to achieve a desired effect. Accordingly, the scope of this invention is to be limited only by the appended claims.

What is claimed is:

1. A Christmas tree ornament spotlight, comprising:

a first hollow housing;

a second hollow housing integrally formed with and forwardly extending from said first housing and having open proximal and distal ends;

means for hanging said first housing from a fixture;

a reflector in said second housing;

a light source mounted in said second housing and said first housing, and being positioned such that said light source can reflect light off said reflector to provide a spotlight beam of light forward from said second housing to nearby objects;

means for electrically connecting said light source to a source of electric power; and means for adjusting the position and attitude of said second housing so as to selectively alter the direction of the beam of light from said second housing either upwardly or downwardly when in operation.

2. The Christmas tree ornament spotlight of claim 1, wherein said first housing is further characterized by a groove cut into the apex of the superior portion of said first housing and extending forwardly and rearwardly from the apex.

3. The Christmas tree ornament spotlight of claim 2, further comprising:

an open eye hook slidably mounted through the groove at the apex of said first housing, means for adjusting the position of said eye hook at any point along the length of the groove; and means for adjusting the horizontal axis of said eye hook relative to the length of the groove.

4. The Christmas tree ornament spotlight of claim 1, wherein said means for hanging said first housing comprises an open-eye hook mounted at substantially the apex of the superior surface of said first housing.

5. The Christmas tree ornament spotlight of claim 1, wherein said first housing includes a bracket for holding a Christmas tree mini-light as a source of light.

6. The Christmas tree ornament spotlight of claim 1, wherein said first housing has an assembly for holding one or more batteries as a source of electric power.

7. A Christmas tree ornament spotlight, comprising:

a first substantially dome-shaped half-sphere having a tapered edge at its circumference and a cut portion extending forwardly and rearwardly from the apex of the superior section of the circumference;

a second substantially dome-shaped half-sphere having a sleeve integrally formed at the circumference of said second half-sphere, suitable for receiving the tapered edge of said first halfsphere and having a cut portion extending forwardly and rearwardly from the apex of the superior section of the circumference, such that when said first half-sphere is coupled with said second half-sphere by sliding the tapered edge of the former into the receiving sleeve of the latter, a hollow spherical housing is formed having a groove at its superior surface;

a first half of a substantially cylindrical member integrally formed with and forwardly extending from said first half-sphere and having open proximal and distal ends;

a second half of a substantially cylindrical member integrally formed with and forwardly extending from said second half-sphere and having open proximal and distal ends such that when said first half-sphere is coupled with said second half-sphere by sliding the tapered edge of the former into the sleeve of the latter, a hollow cylindrical housing is integrally formed with the spherical housing and extends forwardly from the spherical housing;

an open eye hook for hanging said Christmas tree ornament spotlight from a small overhead fixture;

a first substantially rectangular flange member integrally formed at the base of said eye hook and overlying the outer surface of the spherical housing;

a second substantially rectangular inverted T-shaped flange integrally connected to the under surface of said first flange member and underlying the interior surface of the spherical housing;

a reflector positioned in the cylindrical housing formed by the coupled half-spheres and having a forwardly facing concave distal surface and an opening for receiving the bulb portion of a lamp bulb and having a diameter that is substantially the same as the interior surface of the cylindrical housing;

a light source electrically connected to a source of electrical power, mounted in the cylindrical housing and the spherical housing, and being located such that said light source can bounce light off said reflector to provide a generally cylindrical beam of light forward from the cylindrical housing;

a length of insulated double-stranded wire;

a male electrical contact at the terminal end of said length of double-stranded wire suitable for insertion into a light housing on an existing strand of Christmas tree mini-lights;

at least one electrical contact coupling said double-stranded wire to said light source;

means for adjusting the position and attitude of the spherical housing so as to alter the direction of the cylindrical beam of light when in operation;

means for slidably mounting said open eye hook through the groove at the apex of the spherical housing;

means for adjusting the position of said eye hook at any point along the length of the groove; and means for adjusting the horizontal axis of said eye hook relative to the length of the groove.

8. The Christmas tree ornament spotlight of claim 7, wherein said light source comprises a lamp bulb having a filament.

9. The Christmas tree ornament spotlight of claim 7, wherein said light source comprises a standard Christmas tree mini-light.

* * * * *